US011518062B2

(12) United States Patent
Ueno

(10) Patent No.: US 11,518,062 B2
(45) Date of Patent: Dec. 6, 2022

(54) SHEET MANUFACTURING METHOD

(71) Applicant: SEIKO EPSON CORPORATION, Tokyo (JP)

(72) Inventor: Yoshihiro Ueno, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 156 days.

(21) Appl. No.: 17/189,629

(22) Filed: Mar. 2, 2021

(65) Prior Publication Data

US 2021/0178631 A1 Jun. 17, 2021

Related U.S. Application Data

(60) Continuation of application No. 16/818,046, filed on Mar. 13, 2020, now abandoned, which is a division of application No. 15/777,288, filed as application No. PCT/JP2016/083870 on Nov. 20, 2015, now abandoned.

(30) Foreign Application Priority Data

Nov. 20, 2015 (JP) ..... JP2015-227322

(51) Int. Cl.

| | |
|---|---|
| ***B27N 3/04*** | (2006.01) |
| ***B27N 1/02*** | (2006.01) |
| ***D04H 1/60*** | (2006.01) |
| ***D04H 1/732*** | (2012.01) |
| ***D21H 17/33*** | (2006.01) |

(52) U.S. Cl.

CPC ..... *B27N 3/04* (2013.01); *B27N 1/02* (2013.01); *D04H 1/60* (2013.01); *D04H 1/732* (2013.01); *D21H 17/33* (2013.01)

(58) Field of Classification Search

CPC ..... B27N 3/04; B27N 1/02

See application file for complete search history.

(56) References Cited

U.S. PATENT DOCUMENTS

| | | | | |
|---|---|---|---|---|
| 5,118,942 | A * | 6/1992 | Hamade | G03G 15/0291 426/240 |
| 9,422,668 | B2 | 8/2016 | Seki et al. | |
| 9,637,863 | B2 | 5/2017 | Seki et al. | |
| 9,790,642 | B2 | 10/2017 | Nakamura et al. | |
| 9,849,634 | B2 | 12/2017 | Ueno | |
| 9,951,473 | B2 | 4/2018 | Nakamura et al. | |
| 10,253,456 | B2 | 4/2019 | Seki et al. | |
| 2006/0287412 | A1 | 12/2006 | Niizaki | |
| 2013/0319599 | A1* | 12/2013 | Huang | H01M 50/414 156/150 |

(Continued)

FOREIGN PATENT DOCUMENTS

| | | | |
|---|---|---|---|
| CN | 105862249 | A | 8/2016 |
| JP | H02-169632 | A | 6/1990 |

(Continued)

*Primary Examiner* — Timothy Kennedy

(74) *Attorney, Agent, or Firm* — Global IP Counselors, LLP

(57) ABSTRACT

A sheet manufacturing method includes a mixing step of mixing a fiber and a resin powder in air, and a sheet forming step of accumulating and heating a mixture mixed in the mixing step to form a sheet. The resin powder has a volume average particle diameter of equal to or less than 50 μm, and an absolute value of an average charging amount in a range of 5 (μC/g) to 40 (μC/g).

8 Claims, 2 Drawing Sheets

(56) References Cited

U.S. PATENT DOCUMENTS

| | | | |
|---|---|---|---|
| 2014/0290886 | A1 | 10/2014 | Nagai et al. |
| 2015/0247286 | A1 | 9/2015 | Nagai |
| 2015/0275430 | A1 | 10/2015 | Higuchi et al. |
| 2015/0275435 | A1 | 10/2015 | Seki et al. |
| 2016/0068681 | A1 | 3/2016 | Ueno |
| 2016/0229129 | A1 | 8/2016 | Ueno |
| 2016/0230320 | A1 | 8/2016 | Ueno et al. |
| 2016/0230338 | A1 | 8/2016 | Nakamura et al. |
| 2016/0326696 | A1 | 11/2016 | Seki et al. |
| 2017/0198438 | A1 | 7/2017 | Seki et al. |
| 2017/0335516 | A1 | 11/2017 | Nakamura et al. |
| 2018/0072002 | A1 | 3/2018 | Ueno |
| 2019/0316283 | A1 | 10/2019 | Ueno et al. |

FOREIGN PATENT DOCUMENTS

| | | | |
|---|---|---|---|
| JP | H05-230752 | A | 9/1993 |
| JP | 2003-155653 | A | 5/2003 |
| JP | 2004-004405 | A | 1/2004 |
| JP | 2004-240158 | A | 8/2004 |
| JP | 2006-009197 | A | 1/2006 |
| JP | 2011-099172 | A | 5/2011 |
| JP | 2015-066932 | A | 4/2015 |
| JP | 2015-092032 | A | 5/2015 |
| JP | 2015-161047 | A | 9/2015 |
| JP | 2015-183318 | A | 10/2015 |
| JP | 2015-183336 | A | 10/2015 |
| JP | 2016-056470 | A | 4/2016 |
| WO | 2005/019350 | A1 | 3/2005 |

* cited by examiner

SHEET MANUFACTURING METHOD

CROSS REFERENCES TO RELATED APPLICATIONS

This application is a continuation of U.S. patent application Ser. No. 16/818,046, filed on Mar. 13, 2020, which is a divisional application of U.S. patent application Ser. No. 15/777,288, filed on May 18, 2018. The entire disclosures of U.S. patent application Ser. Nos. 15/777,288 and 16/818,046, International Patent Application No. PCT/JP2016/083870 filed on Nov. 15, 2016, and Japanese Patent Application No. 2015-227322 filed on Nov. 20, 2015 are incorporated by reference herein.

TECHNICAL FIELD

The present invention relates to a sheet manufacturing apparatus, a sheet manufacturing method, and a resin powder.

BACKGROUND ART

Accumulating a fiber-like material and causing a bonding force between the accumulated fibers to obtain a sheet-like or film-like formed body has been performed for a long time. Typical examples thereof include manufacturing paper by pulp molding (paper-forming) using water. Even in present times, pulp molding is widely used as an example of a method of manufacturing paper. The paper manufactured by pulp molding generally includes a structure by cellulose fibers derived from wood or the like being entangled with one another, and being partially bonded to one another by a binder (paper strengthening agent (such as a starch paste and a water-soluble resin)).

According to the pulp molding, it is possible for the fibers to be accumulated in a state where uniformity is favorable, and, in a case where a paper strengthening agent is used in the bonding between fibers, it is possible for the paper strengthening agent to be dispersed (distributed) in a state where the uniformity in the paper surface is good. However, because the pulp molding is a wet method, it is necessary to use large volumes of water, and the necessity of dewatering and drying, or the like, arises after forming the paper, and therefore the energy or time consumed is extremely large. It is necessary to suitably process the water used as waste water. Accordingly, it is difficult to respond to modern demands for energy savings, environmental protection, and the like. The apparatuses used in pulp molding frequently need large scale utilities such as water, power, and drainage facilities, and size reductions are difficult. From this viewpoint, there is an expectation of methods, referred to as dry methods that use no or almost no water as paper manufacturing methods in place of pulp molding.

For example, in the technology disclosed in Japanese Unexamined Patent Application Publication No. 2011-099172, an attempt at bonding fibers to one another with a thermal fusion-bondable resin in air-laid non-woven fabric that includes a highly water absorbent resin is disclosed.

SUMMARY

However, in the technology disclosed in Japanese Unexamined Patent Application Publication No. 2011-099172, the thermal fusion-bondable resin has the properties of a powder, and there is a danger of detachment from between the fibers during air-laid. Paragraph [0013] in Japanese Unexamined Patent Application Publication No. 2011-099172 discloses that when thermal fusion-bondable powder is too small, the powder passes through the mesh conveyor (mesh belt) and it is difficult for the fibers to be bonded to one another. Accordingly, Japanese Unexamined Patent Application Publication No. 2011-099172 discloses that it is favorable to use a thermal fusion bondable resin powder of the comparatively large particle diameter (20 mesh pass to 300 mesh on). However, when the particle diameter of the resin is large, the uniformity of the distribution of the resins in a product sheet is impaired and the strength of the sheet may not be constant within the plane. Therefore, in order to uniformly disperse the resins between the fibers, it is desirable that the particle diameter of the resin is smaller. In addition, when forming a web by air laid, in general, suction is performed from under a mesh belt. Then, when the particle diameter of the resin is set to be smaller than the size of the opening of the mesh belt, it becomes easy to be detached from between the fibers at the time of forming a web, and thus it is necessary to devise such that the resin is difficult to be detached from between the fibers.

In the air laid, a method of making it difficult for resin particles to be detached from between fibers is to use electrostatic force. An adhesive force (electrostatic force) to fibers is increased by charging the resin particles. Therefore, it is considered that if the charging amount of the particles of the resin is increased, the particles of the resin tend to be held between the fibers. However, in a case of using such a method, when the charging amount is excessively increased, the adhesive force to an inner wall of a pipe of a manufacturing apparatus and a roller surface also is increased, and thus, as a result, it is found that the amount of the resins remaining between the fibers is decreased.

An advantage of some aspects of the invention is to provide a resin powder that is difficult to be detached from between fibers and is capable of suppressing attachment to an apparatus, and a sheet manufacturing apparatus and a sheet manufacturing method that use the resin powder.

The invention has been made to solve at least a part of the above problems, and can be realized as the following aspects or application examples.

According to one aspect of this disclosure, a sheet manufacturing method comprises a mixing step of mixing a fiber and a resin powder in air, and a sheet forming step of accumulating and heating a mixture mixed in the mixing step to forma sheet. The resin powder has a volume average particle diameter of equal to or less than 50 μm, and an absolute value of an average charging amount in a range of 5 (μC/g) to 40 (μC/g).

According to the one aspect, the resin powder has the average charging amount which is equal to or less than −5 (μC/g) and equal to or greater than −40 (μC/g).

According to the one aspect, the resin powder has the average charging amount which is equal to or less than −15 (μC/g) and equal to or greater than −40 (μC/g).

According to the one aspect, the resin powder has the volume average particle diameter of equal to or less than 30 μm.

According to the one aspect, the resin powder has the volume average particle diameter of equal to or greater than 5 μm.

According to the one aspect, the resin powder has the volume average particle diameter of equal to or greater than 10 μm.

According to the one aspect, the resin powder includes resin particles and inorganic fine particles arranged in a surface of the resin particles.

According to the one aspect, a blending amount of the inorganic fine particles in the resin powder is in a range of 0.1% by mass to 50% by mass.

DESCRIPTION OF EMBODIMENTS

Below, various embodiments of the invention will be described. The embodiments described below are for describing examples of the invention. The invention is not limited in any way by the following embodiments, and includes various modifications carried out in a range not departing from the gist of the invention. Not all of the configurations explained below are indispensable configurations in the invention.

1. Sheet Manufacturing Apparatus

1.1. Configuration

Figure 1:
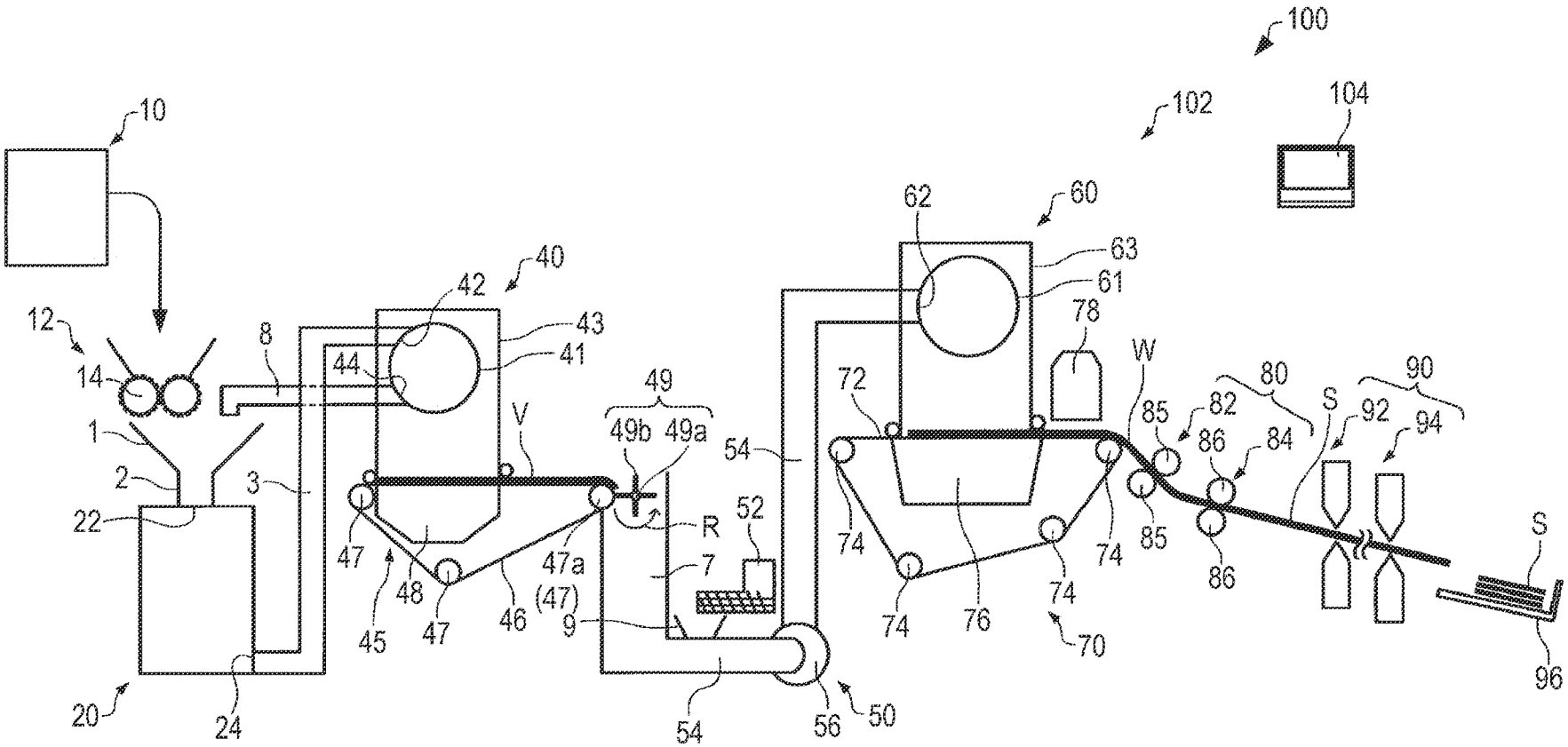
FIG. 1 is a drawing schematically showing a sheet manufacturing apparatus according to an embodiment.

First, a sheet manufacturing apparatus according to the embodiment will be described with reference to the drawings. FIG. 1 is a drawing schematically showing a sheet manufacturing apparatus 100 according to the embodiment.

The sheet manufacturing apparatus 100 is provided with a supplying unit 10, a manufacturing unit 102, and a controller 104, as shown in FIG. 1. The manufacturing unit 102 manufactures a sheet. The manufacturing unit 102 includes a crushing unit 12, a defibrating unit 20, a screening unit 40, a first web forming unit 45, a rotating body 49, a mixing unit 50, an accumulation unit 60, a second web forming unit 70, a sheet forming unit 80, and a cutting unit 90.

The supplying unit 10 supplies raw materials to the crushing unit 12. The supplying unit 10 is an automatic feeding unit for continuously feeding the raw materials to the crushing unit 12. The raw materials supplied by the supplying unit 10 include fibers such as recycled pulp and pulp sheets.

The crushing unit 12 cuts the raw material supplied by the supplying unit 10 into small pieces in air. The shape and size of the small pieces is several cm squared. In the examples in the drawings, the crushing unit 12 includes a crushing blade 14, and it is possible for the fed raw materials to be cut by the crushing blade 14. A shredder is used as the crushing unit 12. The raw material cut by the crushing unit 12 is transferred (transported) to the defibrating unit 20 via a pipe 2 once received by a hopper 1.

The defibrating unit 20 defibrates the raw material cut by the crushing unit 12. Here, the wording "defibrates" refers to untangling the raw material (material to be defibrated) in which a plurality of fibers are bonded into individual fibers. The defibrating unit 20 also has a function of causing substances such as resin powder bonded to the raw material, ink toner, or blur-preventing agent to be isolated from the fibers.

The material that passes through the defibrating unit 20 is referred to as a "defibrated material". There are also cases where resin (resin for causing a plurality of fibers to bond to one another) powder isolated from the fibers when the fibers are untangled, colorants such as ink and toner, and additives such as bleeding inhibitors and paper strengthening agents are included in the "defibrated material" in addition to the untangled defibrated material fibers. The shape of the untangled defibrated material is string-like or ribbon-like. The untangled defibrated material may be present in a state of not being entangled with other untangled fibers (independent state) or may be present in a state being entangled with other untangled defibrated material to form a clump (a state of forming a so-called "lump").

The defibrating unit 20 performs defibration in a dry manner. Here, performing a treatment such as defibration not in liquid but in air such as atmosphere (air) is called a dry process. An impeller mill is used as the defibrating unit 20 in the embodiment. The defibrating unit 20 has the function causing an airflow to be generated so as to suction the raw material and discharge the defibrated material. With this, it is possible for the defibrating unit 20 to suction the raw material along with the airflow from an introduction port 22, perform the defibration treatment, and transport the defibrated material to the exit port 24 with the self-generated airflow. The defibrated material that passes through the defibrating unit 20 is transferred to the screening unit 40 via a pipe 3. Note that, as the airflow for causing the defibrated material to be transported from the defibrating unit 20 to the screening unit 40, an airflow generated by the defibrating unit 20 may be utilized, or an airflow generating device such as a blower may be provided, and an airflow generated therefrom may be used.

The screening unit 40 introduces a defibrated material defibrated by the defibrating unit 20 from the introduction port 42 and screens the material according to fiber length. The screening unit 40 includes a housing portion 43 accommodating a drum portion 41 and a drum portion 41. A sieve is used as the drum portion 41. The drum portion 41 includes a mesh (filter, screen) and is able to divide fibers or particles (first screened material passing through the mesh) that are smaller than the size of the openings of the mesh and included and fibers, non-defibrated pieces or lumps (second screened material not passing through the mesh) larger than the size of the opening in the mesh. For example, the first screened material is transferred to the mixing unit 50 via the pipe 7. The second screened material is returned to the defibrating unit 20 from the exit port 44 via the pipe 8. Specifically, the drum portion 41 is a cylindrical sieve that is able to rotatably driven by a motor. A metal mesh, an expanded metal in which a perforated metal plate is drawn, and a punched metal plate in which holes are formed in a metal plate by a pressing machine or the like are used as the mesh of the drum portion 41.

The first web forming unit 45 transports the first screened material passing through the screening unit 40 to the mixing unit 50. The first web forming unit 45 includes a mesh belt 46, a tensioned roller 47, and a suction unit (suction mechanism) 48.

It is possible for the suction unit 48 to suction the first screened material dispersed in the air after passing through the opening (opening of the mesh) of the screening unit 40 on the mesh belt 46. The first screened material is accumulated on the moving mesh belt 46 and forms the web V. The specific configurations of the mesh belt 46, the tensioned roller 47, and the suction unit 48 are the same as the mesh belt 72, the tensioned roller 74, and the suction mechanism 76 of the second web forming unit 70, described later.

The web V is formed in a state of including large volumes of air and being softly swelled by passing through the screening unit 40 and the first web forming unit 45. The web V accumulated on the mesh belt 46 is fed to the pipe 7 and transported to the mixing unit 50.

The rotating body 49 can cut the web V before transporting the web V to the mixing unit 50. In the examples of the drawings, the rotating body 49 includes a base portion 49*a* and a projection 49*b* projecting from the base portion 49*a*. The projection 49*b* has a plate shape, for example. In the examples of the drawings, four projections 49*b* are provided, and the four projections 49*b* are provided at even intervals. When the base portion 49*a* is rotated in a direction R, the projection 49*b* can make the base portion 49*a* rotated as an axis. When the web V is cut by the rotating body 49, for example, it is possible to reduce fluctuation in the amount of defibrated material per unit time supplied to the accumulation unit 60.

The rotating body 49 is provided in the vicinity of the first web forming unit 45. In the examples of the drawings, the rotating body 49 is provided in the vicinity of (beside the tensioned roller 47*a*) the tensioned roller 47*a* positioned on the downstream side in the path of the web V. The rotating body 49 is provided at a position where the projection 49*b* is in contact with the web V and is not in contact with the mesh belt 46 on which the web V is accumulated. With this, it is possible to suppress the mesh belt 46 from being worn (damaged) by the projection 49*b*. The shortest distance between the projection 49*b* and the mesh belt 46 is, for example, in a range of 0.05 mm to 0.5 mm. The mesh belt 46 is the distance at which the web V can be cut without being damaged.

The mixing unit 50 mixes the first screened material (first screened material transported by the first web forming unit 45) passing through the screening unit 40 and the additive agent that includes a resin. The mixing unit 50 includes an additive agent supply unit 52 that supplies the additive agent, a pipe 54 that transports the first screened material and the additive agent, and a blower 56. In the examples in the drawings, the additive agent is supplied from the additive agent supply unit 52 to the pipe 54 via the hopper 9. The pipe 54 is contiguous with the pipe 7.

An airflow is generated by the blower 56 in the mixing unit 50, and it is possible to transport the first screened material and the additive agent while being mixed in the pipe 54. The mechanism by which the first screened material and the additive agent are mixed is not particularly limited, and may be a mechanism that performs stirring with blades that rotate at high speed, or may be a mechanism that uses the rotation of a container such as a V-type mixer.

A screw feeder as shown in FIG. 1, a disk feeder, not shown, or the like is used as the additive agent supply unit 52. The additive agent supplied from the additive agent supply unit 52 includes a resin for causing the plurality of fibers to bond. At the point in time at which the resin is supplied, the plurality of fibers is not bonded. The resin is fused when passing through the sheet forming unit 80 and the plurality of fibers is bonded.

The resin supplied from the additive agent supply unit 52 is a thermoplastic resin or a heat-curable resin, and is an AS resin, an ABS resin, polypropylene, polyethylene, polyvinyl chloride, polystyrene, an acrylic resin, a polyester resin, polyethylene terephthalate, polyphenylene ether, polybutylene terephthalate, nylon, polyamide, polycarbonate, polyacetal, polyphenylene sulfide, polyetherether ketone, or the like. These resins may be used independently or mixed, as appropriate. The additive agent supplied from the additive agent supply unit 52 may be in the form of a fiber, or may be in the form of a powder.

The additive agent supplied from the additive agent supply unit 52 may include, according to the type of sheet manufactured, coloring agents for coloring the fibers, coagulation inhibitors for preventing aggregation of the fibers and aggregation of resins, and flame retardants for making the fibers and the like more difficult to burn, in addition to the resin that bonds the fibers. The mixture (mixture of the first screened material and the additive agent) passing through the mixing unit 50 is transferred to the accumulation unit 60 via the pipe 54.

The accumulation unit 60 introduces the mixture passing through the mixing unit 50 from the introduction port 62, refines the entangled defibrated material (fibers) and causes the defibrated material to descend while being dispersed in air. The accumulation unit 60 refines the entangled resin in a case where the resin of the additive agent supplied from the additive agent supply unit 52 is in the form of a fiber. In so doing, it is possible for the accumulation unit 60 to cause the mixture to be uniformly accumulated on the second web forming unit 70.

The accumulation unit 60 includes a drum portion 61 and a housing portion 63 accommodating the drum portion 61. A cylindrical sieve that rotates is used as the drum portion 61. The drum portion 61 includes a mesh, and causes the fibers of particles (passing through the mesh) included in the mixture passing through the mixing unit 50 and smaller than the size of the mesh openings to descend. The configuration of the drum portion 61 is that same as the configuration of the drum portion 41.

The "sieve" of the drum portion 61 may not have a function of screening specified target materials. That is, the wording "sieve" used as the drum portion 61 signifies a sieve provided with a mesh, and the drum portion 61 may cause all of the mixture introduced to the drum portion 61 to descend.

The second web forming unit 70 accumulates the passing-through material passing through accumulation unit 60 and forms the web W. The second web forming unit 70 includes a mesh belt 72, a tensioned roller 74, and a suction mechanism 76.

The mesh belt 72 accumulates the passing-through material passing through the openings (openings of the mesh) of the accumulation unit 60 while moving. The mesh belt 72 has a configuration in which the mesh belt 72 is tensioned by the tensioned roller 74, and air that does not easily pass through the passing-through material passes therethrough. The mesh belt 72 moves through the tensioned roller 74 rotating. The web W is formed on the mesh belt 72 by the passing-through material passing through the accumulation unit 60 continuously accumulating while the mesh belt 72 continuously moves. The mesh belt 72 is made from a metal, a resin, fabric, non-woven fabric, or the like.

The suction mechanism 76 is provided below (opposite side to the accumulation unit 60 side) the mesh belt 72. It is possible for the suction mechanism 76 to cause a downward moving airflow (airflow from the accumulation unit 60 to mesh belt 72) to be generated. It is possible for the mixture dispersed in the air by the accumulation unit 60 to be suctioned onto the mesh belt 72 by the suction mechanism 76. In so doing, it is possible for the discharge speed from the accumulation unit 60 to be increased. It is possible to form a down flow in the dropping path of the mixture by the suction mechanism 76, and it is possible to avoid the defibrated material and the additive agent being entangled during dropping.

As above, the web W is formed in a state of including large volumes of air and being softly swelled by passing through the accumulation unit 60 and the second web forming unit 70 (web forming step). The web W accumulated on the mesh belt 72 is transported to the sheet forming unit 80.

In the examples in the drawings, a moisture-adjusting unit 78 that adjusts the moisture of the web W is provided. It is possible for the moisture-adjusting unit 78 to add water or water vapor to the web W and regulate the ratio of the web W to the water.

The sheet forming unit 80 forms the sheet S by pressurizing and heating the web W accumulated on the mesh belt 72. In the sheet forming unit 80, it is possible for the plurality of fibers in the mixture to be bonded to one another via the additive agent (resin) by applying heat to the mixture of the defibrated material and the additive agent mixed into the web W.

The sheet forming unit 80 is provided with a pressurizing unit 82 that pressurizes the web W, and a heating unit 84 that heats the web W pressurized by the pressurizing unit 82. The pressurizing unit 82 is constituted by a pair of calender rollers 85 and applies pressure to the web W. The web W has the thickness reduced by being pressurized, and a density of the web W is increased. A heating roller (heater roller), a hot press molding machine, a hot plate, a hot air blower, an infrared heating device, or a flash fixing device is used as the heating unit 84. In the examples in the drawings, the heating unit 84 is provided with a pair of heating rollers 86. It is possible to form a sheet S while continuously transporting the web W by configuring the heating unit 84 as heating rollers 86, compared to a case of configuring the heating unit 84 as a plate-like press device (plate press device). Here, the calender roller 85 (pressurizing unit 82) can apply a pressure that is higher than the pressure applied to the web W to the web W by the heating roller 86 (heating unit 84). Note that, the number of the calender rollers 85 and the heating rollers 86 is not particularly limited.

The cutting unit 90 cut the sheet S formed by the sheet forming unit 80. In the examples in the drawings, the cutting unit 90 includes a first cutting unit 92 that cut the sheet S in a direction that intersects the transport direction of the sheet S and a second cutting unit 94 that cuts the sheet S in a direction parallel to the transport direction. The second cutting unit 94 cuts the sheet S passing through the first cutting unit 92.

As above, a cut-form sheet S with a predetermined size is formed. The cut-form sheet S that is cut is discharged to the discharge unit 96.

1.2. Fibers

In the sheet manufacturing apparatus 100 of the embodiment, the raw material is not particularly limited, and it is possible for a wide range of fiber materials to be used. Examples of the fibers include natural fibers (animal or plant fibers) and chemical fibers (organic, inorganic or organic-inorganic composite fibers), and more specifically, examples include fibers made from cellulose, silk, wool, cotton, hemp, kenaf, flax, Ramie, jute, manila hemp, sisal hemp, softwood, and hardwood, and fibers made from rayon, lyocell, cupra, vinylon, acrylic, nylon, aramid, polyester, polyethylene, polypropylene, polyurethane, polyimide, carbon, glass, and metal and these may be used independently or mixed, as appropriate, or may be used as a regenerated fiber on which purification or the like is performed. Although examples of the raw material include recycled pulp and recycled cloth, at least one of these fibers may be included. The fiber may be dried or may be contained or be impregnated with a liquid such as water or an organic solvent. Various surface treatments may be performed. The material of the fibers may be a pure material, or may be a material that includes various components such as impurities, additive agents, and other components.

When the fibers used in the embodiment are made one independent fiber, the average diameter (in a case where the cross-section is not a circle, diameter of a circle when a circle having the greatest length from the lengths in a direction perpendicular to the length direction or having an area equivalent to the area of the cross-section (equivalent circle diameter)) thereof is, in average, in a range of 1 μm to 1000 μm, is preferably in a range of 2 μm to 500 μm, and is more preferably 3 μm to 200 μm.

Although the length of the fibers used by the sheet manufacturing apparatus 100 of the embodiment is not particularly limited, in one independent fiber, the length along the length direction of the fiber is in a range of 1 μm to 5 mm, is preferably in a range 2 μm to 3 mm, and is more preferably in a range of 3 μm to 2 mm. In a case where the length of the fibers is short, although the strength of the sheets may be insufficient because the fibers do not easily bond with the composite, it is possible to obtain a sufficiently strong sheet as long as the length is within the above ranges.

The average length of the fibers, as the length-length-weighted mean fiber length, is in a range of 20 μm to 3600 μm, is preferably in a range of 200 μm to 2700 μm, and is more preferably in a range of 300 μm to 2300 μm. The length of the fibers may have variations (distribution), and in a case where a normal distribution in a distribution obtained with an n of 100 or more is assumed, a for the length of one independent fiber may be in a range of 1 μm to 1100 μm, is preferably in a range of 1 μm to 900 μm, and is more preferably in a range of 1 μm to 600 μm. It is possible to measure the thickness and length of the fibers with various optical microscopes, scanning electron microscopes (SEM), transmission electron microscopes, fiber testers, or the like.

In the sheet manufacturing apparatus 100 of the embodiment, the raw material of the fiber is defibrated by the defibrating unit 20, and transported to the mixing unit 50.

1.3. Resin Powders

The additive agent supplied from the additive agent supply unit 52 includes a resin for causing the plurality of fibers to bond. At the point in time at which the additive agent is supplied, the plurality of fibers is not bonded. The resin included in the additive agent is fused when passing through the sheet forming unit 80 and the plurality of fibers is bonded.

In the embodiment, the additive agent supplied from the additive agent supply unit 52 is a powder containing a resin (hereinafter, also referred to as resin powder). The resin powder may be a powder obtained by pulverizing a resin, or may be an aggregate of the resin particles. In addition, the resin powder may contain other substances as long as it contains a resin.

Examples of the material of the resin (resin particles) included in the resin powder include a thermoplastic resin or a heat-curable resin, and is an AS resin, an ABS resin, polypropylene, polyethylene, polyvinyl chloride, polystyrene, an acrylic resin, a polyester resin, polyethylene terephthalate, polyphenylene ether, polybutylene terephthalate, nylon, polyamide, polycarbonate, polyacetal, polyphenylene sulfide, polyetherether ketone, or the like. These resins may be used alone or kneaded appropriately.

More specifically, the type of resin (component of the resin particles) that is a component of the resin powder may be either a natural resin or a synthetic resin, and may be either a thermoplastic resin or a heat-curable resin. In the sheet manufacturing apparatus 100 of the embodiment, the resin that configures the resin powder is preferably a solid at room temperature, and is preferably a thermoplastic resin in consideration of bonding the fibers due to heat in the sheet forming unit 80.

Examples of the natural resin include rosin, dammar, mastic, copal, amber, shellac, dragon's blood palm resin, sandarac, and colophony, and these resins may be independent or mixed, as appropriate, and may be modified as appropriate.

Examples of the heat-curable resin from the synthetic resins include heat-curable resins such as phenol resins, epoxy resins, melamine resins, urea resins, unsaturated polyester resins, alkyd resins, polyurethane, and heat-curable polyimide resins.

Examples of the thermoplastic resin from the synthetic resins include AS resins, ABS resins, polypropylene, polyethylene, polyvinyl chloride, polystyrene, acrylic resins, polyester resins, polyethylene terephthalate, polyphenylene ether, polybutylene terephthalate, nylon, polyamide, polycarbonate, polyacetal, polyphenylene sulfide, and polyetherether ketone.

Copolymerization or modification may be performed, and examples of such systems of resins include styrene resins, acrylic resins, styrene-acrylic copolymer resins, olefin resins, vinyl chloride resins, polyester resins, polyamide resins, polyurethane resins, polyvinyl alcohol resins, vinyl ether resins, N-vinyl resins, and styrene-butadiene resins.

The amount of the resins contained in the resin powder may be equal to or greater than 50% by mass, is preferably in a range of 50% by mass to 99.9% by mass, is more preferably in a range of 60% by mass to 99% by mass, and is still more preferably in a range of 70% by mass to 90% by mass.

The resin powder used in the embodiment is supplied from the additive agent supply unit 52, and receives a frictional charging action at the time of passing through the mixing unit 50 and the accumulation unit 60. In addition, the charged resin powder (composite including the resin) is attached to the fiber, and accumulated on the mesh belt 72 together with the fiber, and thus is attached (electrostatically attract) to the fiber and is difficult to be detached even in a state of becoming the web W.

The absolute value of the average charging amount of the resin powder of the embodiment is in a range of 3 (μc/g) to 50 (μC/g), is preferably in a range of 5 (μC/g) to 40 (μC/g), and is more preferably in a range of 15 (μC/g) to 35 (μC/g). As the absolute value of the average charging amount of the resin powder is increased, the resin powder can be strongly or more frequently attached to the fiber; however, when the absolute value is excessively large, the resin powder is likely to be attached to the blower of the mixing unit, the pipe, and the rollers of the sheet forming unit 80, and thus the absolute value is equal to or less than 50 (μC/g), is more preferably equal to or less than 40 (μC/g).

Further, the average charging amount of the resin powder may be positive or negative, and when the absolute value is within the above range, it is possible to exhibit the above effect. However, the resin particle tends to be charged in a negative state, and thus it becomes a negative value when measured in many cases. In a case where the resin powder is charged in a negative state, the average charging amount of the resin powder of the embodiment is in a range of −3 (μC/g) to −50 (μC/g), is preferably in a range of −5 (μC/g) to −40 (μC/g), and is more preferably in a range of −15 (μC/g) to −35 (μc/g).

The charging amount of the resin powder can be measured by frictionally charging the resin powder. The measurement of the charging amount can be performed, for example, by stirring (mixing) a powder called a standard carrier and a resin powder in the air and measuring the charging amount of the powder. As the standard carrier, for example, a spherical carrier surface treated with ferrite core, and a standard carrier for positively charged polarity toner or negatively charged polarity toner which are available from the Japan Imaging Society (available as the standard carrier for positively charged polarity toner or negatively charged polarity toner, "P-01 or N-01"), a ferrite carrier available from Powdertech Co., Ltd., and the like can be used.

More specifically, the absolute value of the average charging amount of the resin powder can be obtained as follows, for example. A mixed powder having 80% by mass of the carrier and 20% by mass of the resin powder is charged into an acrylic container, and the container is placed on a ball mill base, and is rotated at 100 rpm for 60 seconds so as to mix the carrier and the resin powder (powder). The absolute value [|μc/g|] of the average charging amount can be obtained by measuring the mixture of the mixed resin powder and carrier with a suction type small charging amount measuring device (for example, Model 210 HS-2 manufactured by Trek Corp.).

If the absolute value of the average charging amount of the resin powder is in a range of 3 (μC/g) to 50 (μC/g), the charged resin powder is attached to the fiber, and accumulated on the mesh belt 72 together with the fiber, and thus can be attached (electrostatically attract) to the fiber even in a state of becoming the web W. Also, since the resin powder is difficult to be attached to the rollers of the blower 56, the pipe 54, and the sheet forming unit 80, it is possible to hold a sufficient amount of resins when the sheet S is formed.

The average charging amount of the resin powder can be regulated by selecting the kind and blending amount of the resin contained in the resin powder, and by adding the amount of the regulator and adjusting the additive amount at the time of manufacturing the resin powder. Examples of such a regulator include carbon black, a surfactant, and an inorganic fine particle.

Specific examples of the carbon black include No. 2300, No. 900, MCF88, No. 33, No. 40, No. 45, No. 52, MA7, MA8, MA100, and No. 2200B (which are prepared by Mitsubishi Chemical Corporation), Raven 5750, Raven 5250, Raven 5000, Raven 3500, Raven 1255, and Raven 700 (which are prepared by Columbian Carbon Company), Regal 400R, Regal 330R, Regal 660R, Mogul L, Monarch 700, Monarch 800, Monarch 880, Monarch 900, Monarch 1000, Monarch 1100, Monarch 1300, and Monarch 1400 (which are prepared by Cabot Corporation), and Color Black FW1, Color Black FW2, Color Black FW2V, Color Black FW18, Color Black FW200, Color Black S150, Color Black S160, Color Black S170, Printex 35, Printex U, Printex V, Printex 140U, Special Black 6, Special Black 5, Special Black 4A, and Special Black 4 (which are prepared by Degussa). The carbon black may be kneaded in the resin particles of the resin powder or may be coated on the surface. In many cases, the carbon black can decrease the charging amount of the resin powder.

Specific examples of the surfactant include glycerin fatty acid ester monoglyceride, acetylated monoglyceride, organic acid monoglyceride, medium chain fatty acid triglyceride, polyglycerin fatty acid ester, diglycerin fatty acid ester, sorbitan fatty acid ester, propylene glycol fatty acid ester, and higher alcohol fatty acid ester, any of a nonionic surfactant, an anionic surfactant, a cationic surfactant, and an amphoteric surfactant may be used, and these may be used in combination. The surfactant may be kneaded in the resin particles of the resin powder or may be coated on the surface. The surfactant can change the charging amount of resin powder depending on the types thereof.

Specific examples of the inorganic fine particles include silica (silicon oxide), titanium oxide, aluminum oxide, zinc oxide, cerium oxide, magnesium oxide, zirconium oxide, strontium titanate, barium titanate, and calcium carbonate. The inorganic fine particles arranged in the surface of the resin particles may be a single type or may be a plurality of types. The inorganic fine particles may be kneaded in the resin particles of the resin powder or may be coated on the surface. In many cases, inorganic fine particles can increase the charging amount of the resin powder.

The blending amount of these regulators in the resin powder is equal to or less than 50% by mass in total. Even without the regulator, if the absolute value of the average charging amount of the resin powder is within the above range, the blending may not be performed. The blending amount of the regulator in a case where the regulator is blended is preferably in a range of 0.1% by mass to 50% by mass, is more preferably in a range of 1% by mass to 40% by mass, and is still more preferably in a range of 10% by mass to 30% by mass. When the blending amount is within the above range, the absolute value of the average charging amount of the resin powder can be set as a value within the above-described range.

The particle diameter of the particle of the resin powder (volume-based average particle diameter) is in a range of 5 μm to 50 μm, is preferably in a range of 7 μm to 40 μm, is more preferably in a range of 8 μm to 30 μm, still more preferably in a range of 8 μm to 20 μm, and is particularly preferably in a range of 8 μm to 12 μm. When the average particle diameter is small, the gravity acting on the resin powder is decreased, so that detachment from the fibers due to its own weight can be suppressed, and since the air resistance is decreased, the detachment from the fibers due to the airflow (wind) generated by the suction mechanism 76, or the detachment due to the mechanical vibration can be suppressed. In addition, if the resin powder is within the above particle diameter range, when the absolute value of the average charging amount of the resin powder is in a range of 3 (μC/g) to 50 (μC/g), the resin powder is difficult to be sufficiently detached from the fibers and to be attached to the blower, the pipe, and the rollers of the sheet forming portion 80.

In addition, the distribution of the particle diameters of the resin particles of the resin powder is not particularly limited, and from the volume average particle diameter, the particle diameters are distributed in a range of 50% to 300%, is preferably in a range of 60% to 250%, is more preferably in a range of 70% to 200%. Since the volume average particle diameter is an average particle diameter sensitive to coarse particles, the volume average particle diameter tends to be larger than other average particle diameters (for example, number average particle diameter) due to the presence of coarse particles. Therefore, the volume average particle diameter is more preferable as an index in the resin powder of the present embodiment from the viewpoint of reducing coarse particles which are likely to cause uneven distribution of the resin in the sheet S.

Note that, although the opening of the mesh belt 72 can be properly set, the resin powder is attached to the fiber, and thus it is suppressed from passing through the mesh belt 72 even in a case where the particle diameter of the resin powder is smaller than the opening of the mesh belt 72 (the size of the hole through which the object passes). That is, the resin powder of the embodiment has a more remarkable effect when the particle diameter of the resin powder is smaller than the opening of the mesh belt 72.

The volume average particle diameter of the particles of the resin powder can be measured by, for example, a particle size distribution analyzer using the laser diffraction scattering method as the measurement principle. As a particle size distribution analyzer, for example, a particle size distribution meter ("Microtrack UPA" manufactured by Nikkiso Co., Ltd.) using a dynamic light scattering method as a measuring principle can be mentioned.

The additive agent may contain other components in addition to the resin powder. Examples of the other components include organic solvents, surfactants, preservative and fungicide agents, antioxidants, ultraviolet absorbing agents, and oxygen absorbing agents. In addition, although it has been described that coloring agents for coloring fibers, or flame retardants for making fibers or the like more difficult to burn may be included in the resin powder, in cases where at least one type of these is included, it is possible for these effects to be more easily obtained by blending these into the resin by melt-kneading. The inorganic fine particles may be blended by mixing the resin powder and the inorganic fine particle powder with a high-speed mixer or the like after forming such as resin powder.

Although the above-described fibers and the resin powder (additive agent) are mixed together in the mixing unit 50, it is possible for the mixing ratio thereof to be regulated, as appropriate, according to the strength, usage, or the like of the manufactured sheet S. If the manufactured sheet S is for a work usage, such as copy paper, the proportion of the resin powder to the fibers is 5% by mass or more to 70% by mass or less, and from the viewpoints of obtaining favorable mixing in the mixing unit 50 and making the resin powder more difficult to detach due to gravity in a case where the mixture is formed in a sheet-shape, it is preferable to be in a range of 5% by mass to 50% by mass.

1.4. Mixing Unit

The mixing unit 50 provided in the sheet manufacturing apparatus 100 of the embodiment has a function of causing the fibers and the resin powder to be mixed together. At least the fibers and the resin powder are mixed together in the mixing unit 50. In the mixing unit 50, components other than the fibers and the resin powder may be mixed together. The wording "the fibers and the resin powder are mixed together" in the specification is defined as the resin powder being positioned between the fibers in a space (system) with a fixed volume.

The process of mixing together in the mixing unit 50 of the embodiment is a method (dry-type) in which the fibers and the resin powder are introduced into the airflow and diffused together in the airflow, and is a fluid dynamic mixing process. The wording "dry-type" in the mixing refers to the state of being mixed together in air (air, not in liquid) rather than in water. That is, the mixing unit 50 may function in the drying state, or may function in a state where a liquid present as an impurity or an intentionally added liquid is present. In the case of intentionally adding the liquid, it is preferable for the liquid to be added to an extent that the energy and time for removing the liquid through heating or the like do not increase excessively in later processes. In the method, this is more preferable because the airflow in the pipe 54 or the like being turbulent make the mixing together efficient.

The processing capacity of the mixing unit 50 is not particularly limited as long as it is able to cause the fibers (fibrous material) and the resin powder to mix together, and it is possible to regulate the design, as appropriate, according to the manufacturing capacity (throughput) of the sheet manufacturing apparatus 100. It is possible for the regulation of the processing capacity of the mixing unit 50 to be performed by the flow rate of the gas for transferring the fibers and the resin powder in the pipe 54, the introduction amount of the material, and the transfer amount or the like being changed.

The mixture mixed together by the mixing unit 50 may be further mixed by another configuration such as a sheet forming unit. In the example in FIG. 1, although the mixing unit 50 includes a blower 56 provided in the pipe 54, a further blower, not shown, may be included.

The blower is a mechanism in which the fibers and the resin powder are mixed, and includes a rotary unit having blades that rotate. By the blades rotating, either or both of the fibers and the resin powder are rubbed by the blades or impact the blades. By the blades rotating, any or all of the fibers and the fibers, the fibers and the resin powder and the resin powder and the resin powder impact each other and rub against one another according to the airflow formed by the blades.

It is thought that due to such impact or rubbing, at least the resin powder is charged (charged with static electricity), and an adhesive force (electrostatic force) for attaching the resin powder to the fibers is generated. The strength of such an adhesive force depends on the properties of the fibers and the resin powder and the structure (shape and the like of the rotating blades) of the blower. Even in cases where one blower 56 is provided as shown in FIG. 1, although it is possible to obtain a sufficient adhesive force, there are cases where it is possible to obtain a stronger adhesive force by further providing another blower on the downstream side of the additive agent supply unit 52. The increasing number of blowers is not particularly limited. In a case of providing a plurality of blowers, the main functions of the blowers may be divided such as providing a blower with a strong air blowing force, a blower with a larger stirring force (capability caused by being charged) or the like. In this way, there are cases where it is possible for adhesive force of the resin powder to the fibers to be further increased, and it is possible for detachment of the resin powder from between the fibers to be further suppressed when forming the web W.

1.5. Action and Effect

In the sheet manufacturing apparatus 100 of the embodiment, the resin powder mixed into the fiber in the mixing unit 50 has a volume average particle diameter of equal to or less than 50 μm, and the absolute value of the average charging amount in a range of 5 (μC/g) to 40 (μC/g), and thus when the web is formed, the resin powder is difficult to be detached from between the fibers. In addition, the absolute value of the average charging amount is in a range of 5 (μC/g) to 40 (μC/g), and thus in the mixing unit 50, the web forming unit 60, and the sheet forming unit 80, the attachment of the resin powder to the member is suppressed. With this, it is possible to make the amount (proportion relative to fibers) of the blended additive agents (resin powder) a value close to the design. That is, dissipation of the additive agents in the apparatus can be suppressed. Further, the resin powder and the fiber are bonded to each other in the sheet forming unit 80, and thus it is possible to manufacture a sheet having good resin dispersibility and good uniformity such as strength.

2. Sheet Manufacturing Method

The sheet manufacturing method of the embodiment includes a mixing step of mixing fibers and the resin powders in the air, and a sheet forming step of forming a sheet by accumulating the mixture mixed in the mixing step and heating. Details of the fiber and the resin powder are the same as those described in the above-described sheet manufacturing apparatus, and thus detailed description will not be repeated.

The sheet manufacturing method of the embodiment may include at least one step selected from a group composed of a step for cutting a pulp sheet or recycled pulp as a raw material in air, a defibrating step of disentangling the raw material in air into a fibrous form, a screening step of screening impurities (toner or paper strengthening agent) and fibers (short fibers) shortened by defibration from the defibrated material that is defibrated, and in air, long fibers and undefibrated pieces that are insufficiently defibrated from the defibrated material, a dispersing step of causing the mixture to descend while being dispersed in air, a forming step of forming the descended mixture in a web shape or the like while being accumulated in air, a drying step of causing the sheet to be dried as necessary, a winding step of winding the formed sheet into a roll shape, a cutting step of cutting the formed sheet, and a packaging step of packaging the manufactured sheet. The details of these steps are the same as those described in the above-described sheet manufacturing apparatus, and thus detailed description will not be repeated.

According to the sheet manufacturing method of the embodiment, the resin powder and the fiber having an appropriate absolute value of the average charging amount are mixed, and thus the resin particles of the resin powder are charged and easily attached to the fiber during mixing, so that when the resin particles are accumulated, it is more difficult for the resin particle to be detached from between the fibers and difficult for the resin powder to be attached to a member of the manufacturing apparatus. With this, it is possible to efficiently manufacture a sheet with favorable strength.

3. Sheet

The sheet S manufactured by the sheet manufacturing apparatus 100 or the sheet manufacturing method of the embodiment indicates a sheet in which at least the above-described fibers are the raw material and formed into a sheet form. However, there is no limitation to a sheet form, and the shape may be a board form, web form, or a shape having concavities and convexities. The sheets in the specification can be classified into paper and non-woven fabric. Paper includes forms in which pulp or recycled pulp as a raw material is formed in a sheet form, and includes recording paper for the purpose of writing or printing, wallpaper, packaging paper, colored paper, image paper, Kent paper, and the like. Non-woven fabric is a product thicker than paper or with low strength, and includes ordinary non-woven fabric, fiber boards, tissue papers, kitchen papers, cleaners, filters, liquid absorbing materials, sound absorbers, shock absorbers, mats, and the like.

In the case of non-woven fabric, the interval between fibers is wide (density of the sheet is low). In contrast, the paper has a narrow interval between fibers (density of the sheet is high). Therefore, the sheet S manufactured by the sheet manufacturing apparatus 100 or the sheet manufacturing method of the embodiment being a paper is more able to remarkably express the action and function of suppressing detachment of the resin powder from the fibers, uniformity of strength when formed as a sheet or the like.

4. Other Provisions

Although the sheet manufacturing apparatus and sheet manufacturing method of the embodiment use no or only a small amount of water, it is possible to manufacture the sheet while adding water, as appropriate, with the object of adjusting the moisture or the like, through spraying or the like as necessary.

It is preferable to use pure waters such as ion-exchange water, ultrafiltered water, reverse osmosis water, and distilled water or ultrapure water as the water. In particular, because water in which these waters are subjected to sterilization treatment by irradiation with ultraviolet rays or addition of hydrogen peroxide is able to suppress the generation of mold and bacteria over a long period of time, such water is preferable.

In the specification, the phrasing "uniform" indicates, in a case of uniform dispersion or mixing, the relative positions where one component is present with respect to the other component are even in the entire system or are the same or substantially equal in each part of the system to one another in a substance able to define a component with two types or more or two phases or more. Uniformity of coloring or uniformity of tone indicates an even concentration without tinting of the color when the sheet is seen in plan view.

In the specification, phrasing such as "uniform", "same", "even intervals" and the like are used to indicate that density, distance, measurement or the like are the same. Although it is desirable that these are equal, because being made completely equal is difficult, the wording includes being shifted by the cumulative errors or variations without the values being equal.

5. Experimental Examples

Although the invention will be further described by the examples shown, the invention is not limited to the Experimental Examples below.

5.1. Preparation of Additive Agent (Resin Powder)

Samples of Experimental Examples 1 to 12 were prepared as follows.

The resin and regulator indicated in Table 1 were charged into a high-speed mixer at the mass indicated in Table 1 and dry blended. In Experimental Examples 5 and 11, the regulator is not blended. Each obtained blend was introduced into a twin screw kneading extruder and kneaded at 90° C. to 130° C. to form a strand, and the strand was pelletized. The obtained pellet was pulverized with a hammer mill and further pulverized by a jet mill. Then, classification was carried out by a forced vortex centrifugal classifier to obtain resin powders having the particle diameter range as indicated in Table 1, respectively. The volume average particle diameter was obtained using Microtrac UPA (manufactured by Nikkiso Co., Ltd.).

TABLE 1

| Experimental Example No. | Regulator | Resin | Blending amount (regulator/resin) (g/g) | Volume average particle diameter (μm) | Particle diameter range (μm) |
|---|---|---|---|---|---|
| 1 | Ketjen black EC300J prepared by LION SPECIALTY CHEMICALS CO., Ltd. | ACT-6202 prepared by DIC Corporation | 500/9500 | 10 ± 2 | 5 to 25 |
| 2 | Carbon black MA7 prepared by Mitsubishi Chemical Corporation | | 600/9400 | | |
| 3 | RIKEMAL P-300 prepared by RIKEN VITAMIN CO., LTD. | | 400/9600 | | |
| 4 | DUSPER 1400B prepared by Miyoshi Oil & Fat Co., Ltd. | | 200/9800 | | |
| 5 | None | | 0/10000 | | |
| 6 | Carnauba wax (melting point 86° C.) | | 400/9600 | | |
| 7 | Ketjen black EC300J prepared by LION SPECIALTY CHEMICALS CO., Ltd. | | 500/9500 | 54 ± 2 | 47 to 65 |
| 8 | Carbon black MA7 prepared by Mitsubishi Chemical Corporation | | 600/9400 | | |
| 9 | RIKEMAL P-300 prepared by RIKEN VITAMIN CO., LTD. | | 400/9600 | | |
| 10 | DUSPER 1400B prepared by Miyoshi Oil & Fat Co., Ltd. | | 200/9800 | | |

TABLE 1-continued

| Experimental Example No. | Regulator | Resin | Blending amount (regulator/resin) (g/g) | Volume average particle diameter (μm) | Particle diameter range (μm) |
|---|---|---|---|---|---|
| 11 | None | | 0/10000 | | |
| 12 | Carnauba wax (melting point 86° C.) | | 400/9600 | | |

Next, 3000 g of the resin powders of each Experimental Example and inorganic fine particles of the kinds and amounts indicated in Table 2 were introduced into a high-speed mixer and stirred for 90 seconds at 2000 rpm. Powders after stirring were sieved by 150 mesh SUS filter, and the powders that passed were taken as powders of each Experimental Example.

TABLE 2

| Experimental Example No. | Mass of resin powder (g) | Inorganic fine particles prepared by Evonik Japan | Mass of inorganic fine particle (g) |
|---|---|---|---|
| 1 | 3000 | NX90G | 21 |
| 2 | | RX200 | 39 |
| 3 | | RX200 | 39 |
| 4 | | RX200 | 39 |
| 5 | | RX200 | 39 |
| 6 | | NKT90 | 75 |
| 7 | | NX90G | 21 |
| 8 | | RX200 | 39 |
| 9 | | RX200 | 39 |
| 10 | | RX200 | 39 |
| 11 | | RX200 | 39 |
| 12 | | NKT90 | 75 |

5.2. Mixing Fiber and Resin Powder 22.5 g of softwood bleached kraft pulp and 7.5 g of the resin powder of each of Experimental Examples above were weighed and placed in a clean polyethylene wide-mouth ointment bottle (capacity 1000 ml) in an order of softwood bleached kraft pulp, and the resin powder, and the bottle was capped. A ball mill rotating stand was rotated in each Experimental Example for 8 minutes by adjusting the rotation speed so that the peripheral speed of the bottle was 15 m/min when the bottle was mounted.

5.3. Manufacturing of Sheet

The mixture of each Experimental Example obtained as above was extracted while preventing vibration and airflow as much as possible and subjected to hot press processing at a temperature of 150° C. and a pressure of 15 MPa for 30 seconds so as to melt the resin and allowed to cool, and thereby a sheet of each experimental Example can be obtained.

5.4. Measurement of Amount of Resin Powder Contained in Sheet

Approximately 10 mg from three different sheets were cut out from the sheet of each experimental Example so as to prepare a test piece. Thermogravimetry of each sample was performed so as to determine a mass proportion of the resin powder contained in a test piece, which was set as the retention rate of the resin powder. The retention rate was obtained by averaging the three test pieces. Note that, it is known that when the retention rate is approximately equal to or greater than 50%, sufficient sheet strength can be obtained practically, but it is more preferable that the retention rate be more than 70%.

5.5. Measurement of Frictional Charging Amount 0.25 g of the resin powder of each Experimental Example and 4.75 g of a carrier (Distributed article of the Imaging Society of Japan N-01) were weighed out in a styrol screw bottle (volume: 5 ml). A lid of the styrol screw bottle was closed, then the bottle was placed on a ball milling stand, and rotated at 100 rpm for three minutes so as to frictionally charge the resin powder. A mixture of 0.25 nm of the carrier and the resin powder was extracted from the styrol screw bottle, and the average charging amount was measured by the charging amount measuring instrument of a suction blow-off system (Model 210 HS-2 manufactured by Trek Corp.). Each resin powder was measured three times so as to obtain an average value.

5.6. Evaluation Results

Figure 2:
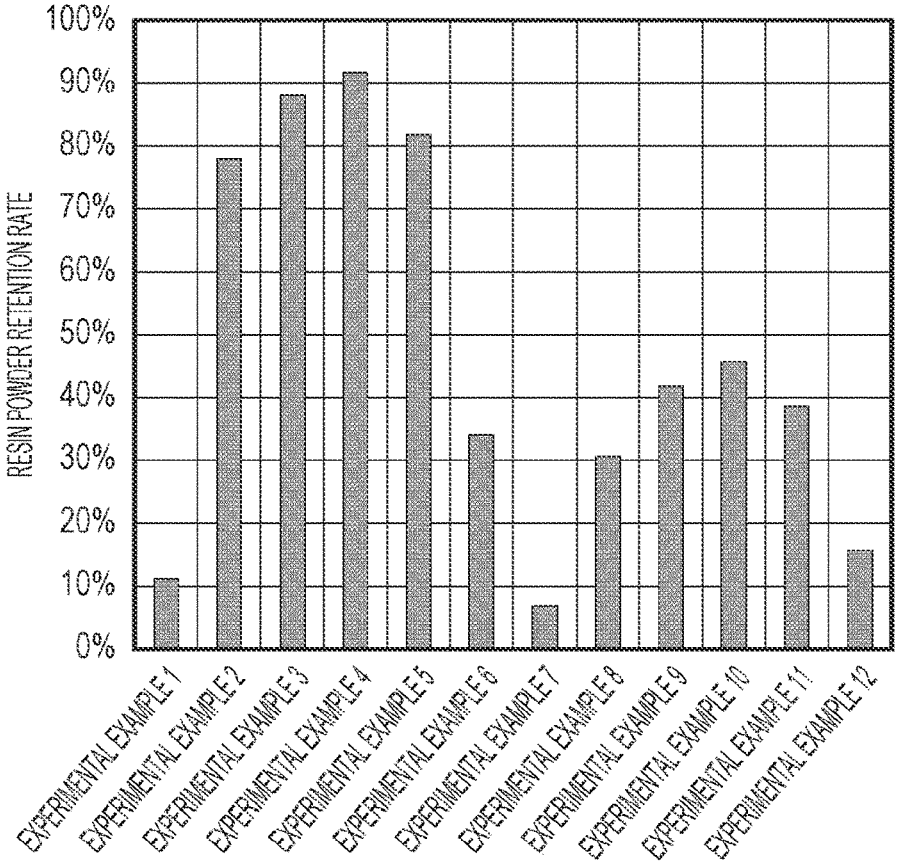
FIG. 2 is a graph illustrating a retention rate of resin powder of the sheet of Experimental Example.

FIG. 2 is a bar graph of the retention rate of the resin powders in the sheet obtained for each Experimental Example. Referring to FIG. 2, 100% retention rate was not achieved in all of Experimental Examples 1 to 12, but the portion which is not retained in the sheet is presumed to remain in a polyethylene wide-mouth ointment bottle. In other words, in consideration of the sheet manufacturing apparatus, it seems to remain in a member such as mixing unit.

On the other hand, with reference to a value of the retention rate in FIG. 2, when comparing Experimental Examples 1 and 6 to Experimental Examples 7 to 12, Experimental Examples 1 to 6 exhibit a higher retention rate. From this, it can be seen that when the volume average particle diameter of the resin powder is equal to or less than 50 μm, the retention rate is high. Also, from Experimental Examples 2 to 5, it was found that the retention rate is very high at 10 μm±2 μm. This is considered to be caused by the fact that the smaller the particle diameter is, the less susceptible to wind, the larger the adhesive force/mass ratio, the smaller the inertia when impact or the like is applied. In a case where the particle diameter was large, attachment to the inner wall of the bottle was also relatively small.

Figure 3:
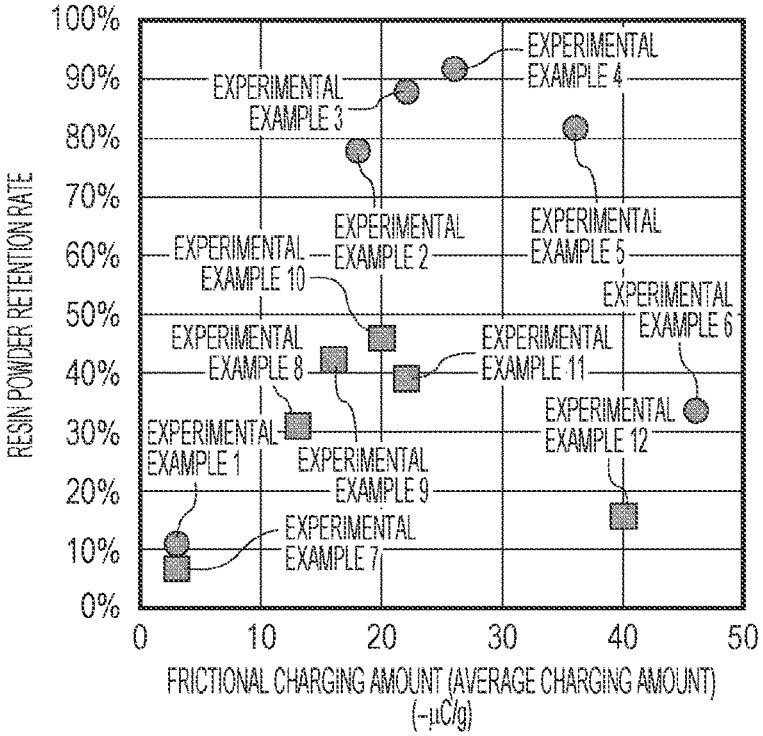
FIG. 3 is a scatter diagram illustrating a relationship between the retention rate of the resin powder and the frictional charging amount according to Experimental Example.

FIG. 3 is a scatter diagram of the results of each Experimental Example in the graph with the resin powder retention rate on a vertical axis and the frictional charging amount on a horizontal axis. Measurement values were indicated in Table 3.

TABLE 3

| Experimental Example No. | Frictional charging amount (−μC/g) | Retention rate of resin powder (with respect to charging (%) amount) | Volume average particle diameter (μm) |
|---|---|---|---|
| 1 | 3 | 11 | 10 ± 2 |
| 2 | 18 | 78 | |
| 3 | 22 | 88 | |
| 4 | 26 | 92 | |
| 5 | 36 | 82 | |
| 6 | 46 | 34 | |
| 7 | 3 | 7 | 54 ± 2 |
| 8 | 13 | 31 | |
| 9 | 16 | 42 | |
| 10 | 20 | 46 | |
| 11 | 22 | 39 | |
| 12 | 40 | 16 | |

When referring to FIG. 3, it was found that the retention rate of the resin powder was changed by the frictional charging amount (average charging amount). In a case where the charging amount is less than −5 μC/g (absolute value is small), the amount of powders attached to the bottle and the amount of powders attached to the fibers were both small. Therefore, it is considered that when the charging amount is excessively small, attachment (loss) to the apparatus is reduced, but the adhesive force to fibers is also small, a retention rate is decreased.

In a case where an absolute value of the frictional charging amount (average charging amount) is large, in Experimentation 6, the frictional charging amount was −46 μC/g, in which the absolute value was large, but the retention rate of the resin powder in the fiber was insufficient. This suggests that when the charging amount is excessively large, although the attachment to the fibers can be expected to increase, the attachment (loss) to the apparatus is even greater, thereby resulting in a decrease in the retention rate.

From the above results, it was found that in order to attach more resin powders to the fibers and lessen the attachment of the resin powder to the members of the apparatus in the sheet manufacturing apparatus in the form of mixing the fibers and the resin powders, the resin powder preferably has the following properties.

(1) The volume average particle diameter is preferably as small as possible, and it is equal to or less than 50 μm, and is preferably equal to or less than 10 μm. (2) The higher the average charging amount of the resin powder is, the better it is; however, if the average charging amount is excessively high, the resin powder tends to be attached to the members of the apparatus such as a mixing device, a roller, and a pipe. (3) From the (2), when there is a suitable range for the absolute value of the average charging amount of the resin powder, and the absolute value of the average charging amount is in a range 5 (μC/g) to 40 (μC/g), good results with a retention rate of equal to or greater than 70% are obtained.

According to an aspect, there is provided a sheet manufacturing apparatus including a mixing unit that mixes a fiber and a resin powder in air, a sheet forming unit that accumulates and heats a mixture mixed by the mixing unit to form a sheet, in which the resin powder has a volume average particle diameter of equal to or less than 50 μm, and an absolute value of an average charging amount in a range of 5 (μC/g) to 40 (μC/g).

According to the sheet manufacturing apparatus in this application example, the resin powder and the fiber having an appropriate absolute value of the average charging amount are mixed, and thus the resin particles of the resin powder are charged and easily attached to the fiber during mixing, so that even when the web is formed, it is difficult for the resin particle to be detached from the fibers and difficult for the resin powder to be attached to a member of the manufacturing apparatus. With this, it is possible to efficiently manufacture a sheet with favorable strength.

In the sheet manufacturing apparatus according to the aspect, the resin powder may have an average charging amount which is equal to or less than −5 (μC/g) and equal to or greater than −40 (μC/g).

According to the sheet manufacturing apparatus in this application example, the resin particles of the resin powder are charged and more easily attached to the fiber during mixing, so that when the web is formed, it is more difficult for the resin particle to be detached from the fibers and attached to a member of the manufacturing apparatus after the mixing.

In the sheet manufacturing apparatus according to the aspect, the resin powder may have an average charging amount which is equal to or less than −15 (μC/g) and equal to or greater than −40 (μC/g).

According to the sheet manufacturing apparatus in this application example, the resin particles of the resin powder are charged and more easily attached to the fiber during mixing.

In the sheet manufacturing apparatus according to the aspect, the resin powder may have a volume average particle diameter of equal to or less than 30 μm.

According to the sheet manufacturing apparatus in this application example, it is more difficult for the resin particle to be detached from the fibers and to be attached to a member of the manufacturing apparatus after the mixing.

In the sheet manufacturing apparatus according to the aspect, the resin powder may have a volume average particle diameter of equal to or greater than 5 μm.

In the sheet manufacturing apparatus according to the aspect, the resin powder may have a volume average particle diameter of equal to or greater than 10 μm.

According to another aspect, there is provided a sheet manufacturing method including a mixing step of mixing a fiber and a resin powders in air, and a sheet forming step of accumulating and heating a mixture mixed in the mixing step to form a sheet, in which the resin powder has a volume average particle diameter of equal to or less than 50 μm, and an absolute value of an average charging amount in a range of 5 (μC/g) to 40 (μC/g).

According to the sheet manufacturing method in this application example, the resin powder and the fiber having an appropriate absolute value of the average charging amount are mixed, and thus the resin particles of the resin powder are charged and easily attached to the fiber during mixing, so that when the resin particles are accumulated, it is difficult for the resin particles to be detached from the fibers and difficult for the resin powder to be attached to a member of the manufacturing apparatus. With this, it is possible to efficiently manufacture a sheet with favorable strength.

According to still another aspect, there is provided a resin powder, in which a volume average particle diameter is equal to or less than 50 μm, and an absolute value of an average charging amount in a range of 5 (μC/g) to 40 (μC/g).

The resin powder according to this application example has an appropriate absolute value of the average charging amount. For this reason, at the time of mixing the resin particle with the fiber, the resin particles of the resin powder are charged so as to be easily attached to the fiber, and are difficult to be attached to the member of the manufacturing apparatus. Therefore, according to the resin powders of application example, it is possible to efficiently manufacture a sheet with favorable strength.

In the resin powder according to the aspect, an average charging amount is equal to or less than −5 (μC/g) and equal to or greater than −40 (μC/g).

In the resin powder according to the aspect, an average charging amount is equal to or less than −15 (μC/g) and equal to or greater than −40 (μC/g).

In the resin powder according to the aspect, a volume average particle diameter is equal to or less than 30 μm.

In the resin powder according to the aspect, a volume average particle diameter is equal to or greater than 5 μm.

In the resin powder according to the aspect, a volume average particle diameter is equal to or greater than 10 μm.

The invention is not limited to the embodiments described above, and further, various modifications thereof are possible. For example, the invention includes configurations which are substantially the same as the configurations described in the embodiments (for example, configurations having the same function, method, and results, or configurations having the same purpose and effect). The invention includes configurations in which non-essential parts of the configurations described in the embodiments are replaced. The invention includes configurations exhibiting the same actions and effects as the configurations described in the embodiments or configurations capable of achieving the same object. The invention includes configurations in which known techniques were added to the configurations described in the embodiments.

REFERENCE SIGNS LIST

1 . . . hopper,
2, 3, 4, 5, 7, 8 . . . pipe,
9 . . . hopper,
10 . . . supplying unit,
12 . . . crushing unit,
14 . . . crushing blade,
20 . . . defibrating unit,
22 . . . introduction port,
24 . . . exit port,
40 . . . screening unit,
41 . . . drum portion,
42 . . . introduction port,
43 . . . housing portion,
44 . . . exit port,
45 . . . first web forming unit,
46 . . . mesh belt,
46*a* . . . accumulation surface,
47, 47*a* . . . tensioned roller,
48 . . . suction unit,
49 . . . rotating body,
49*a* . . . base portion,
49*b* . . . projection,
50 . . . mixing unit,
52 . . . additive agent supply unit,
54 . . . pipe,
56 . . . blower,
60 . . . accumulation unit,
61 . . . drum portion,
62 . . . introduction port,
63 . . . housing portion,
70 . . . second web forming unit,
72 . . . mesh belt,
74 . . . tensioned roller,
76 . . . suction mechanism,
78 . . . moisture-adjusting unit,
80 . . . sheet forming unit,
82 . . . pressurizing unit,
84 . . . heating unit,
85 . . . calender roller,
86 . . . heating roller,
90 . . . cutting unit,
92 . . . first cutting unit,
94 . . . second cutting unit,
96 . . . discharge unit,
100 . . . sheet manufacturing apparatus,
102 . . . manufacturing unit,
104 . . . controller,
S . . . sheet,
V . . . web,
W . . . web

The invention claimed is:

1. A sheet manufacturing method comprising:

a mixing step of mixing a fiber and a resin powder in air; and a sheet forming step of accumulating and heating a mixture mixed in the mixing step to form a sheet, wherein the resin powder has a volume average particle diameter of equal to or less than 50 μm, and an absolute value of an average charging amount in a range of 5 (μC/g) to 40 (μC/g).

2. The sheet manufacturing method according to claim 1, wherein the resin powder has the average charging amount which is equal to or less than −5 (μC/g) and equal to or greater than −40 (μC/g).

3. The sheet manufacturing method according to claim 1, wherein the resin powder has the average charging amount which is equal to or less than −15 (μC/g) and equal to or greater than −40 (μC/g).

4. The sheet manufacturing method according to claim 1, wherein the resin powder has the volume average particle diameter of equal to or less than 30 μm.

5. The sheet manufacturing method according to claim 1, wherein the resin powder has the volume average particle diameter of equal to or greater than 5 μm.

6. The sheet manufacturing method according to claim 1, wherein the resin powder has the volume average particle diameter of equal to or greater than 10 μm.

7. The sheet manufacturing method according to claim 1, wherein the resin powder includes resin particles and inorganic fine particles arranged in a surface of the resin particles.

8. The sheet manufacturing method according to claim 7, wherein a blending amount of the inorganic fine particles in the resin powder is in a range of 0.1% by mass to 50% by mass.

* * * * *